US005379029A

United States Patent [19]

Kuo-Tang et al.

[11] Patent Number: 5,379,029

[45] Date of Patent: Jan. 3, 1995

[54] SENSING DECORATIVE TREE

[76] Inventors: Cheng Kuo-Tang; Hung Ching-Ho, both of P.O.Box 82-144, Taipei, Taiwan, Prov. of China

[21] Appl. No.: 152,377

[22] Filed: Nov. 16, 1993

[51] Int. Cl.[6] ..... G08B 23/00

[52] U.S. Cl. ..... 340/693; 340/540; 340/541; 340/567; 340/692

[58] Field of Search ..... 340/693, 692, 567, 541, 340/540

[56] References Cited

U.S. PATENT DOCUMENTS

| | | | |
|---|---|---|---|
| 4,075,614 | 2/1978 | White | 340/693 |
| 4,816,809 | 3/1989 | Kim | 340/692 |
| 4,904,988 | 2/1990 | Nesbit et al. | 340/693 |
| 4,940,965 | 7/1990 | Umehara | 340/692 |
| 4,978,942 | 12/1990 | Bruce | 340/693 |

*Primary Examiner*—Glen Swann
*Attorney, Agent, or Firm*—Alfred Lei

[57] ABSTRACT

A sensing decorative tree includes a pot provided with a raised annular member on the bottom and a plurality of protuberances on the inner side, a trunk having a lower end engaged with the raised annular member of the pot, a partition plate mounted on the protuberances of the pot, an artificial lawn mounted on the partition plate, a voice producer mounted on the bottom of the partition plate, an amplifier mounted on the pot and electrically connected with the voice producer, a sleeve inserted in the upper outlet of a passage of the trunk, a sensing wire provided at one end with a plug connected with the voice producer and at the other end with a sensor received in sleeve, a volume control mounted in the pot and electrically connected with the amplifier for controlling volume of the amplifier, and a plurality of flexible canes twisted on the trunk and provided at one end with a plug electrically connected with the voice producer and at the other end with a sensor.

3 Claims, 5 Drawing Sheets

SENSING DECORATIVE TREE

BACKGROUND OF THE INVENTION

It has been found that the conventional decorative tree can be used for decoration only and has no other functions. Further, the conventional burglar-proof alarm must be disposed in a hidden place in order to prevent it from being observed from outside thereby making much inconvenience in use.

Therefore, it is an object of the present invention to provide a sensing decorative tree which may obviate and mitigate the above-mentioned drawbacks.

SUMMARY OF THE INVENTION

This invention relates to a sensing decorative tree.

It is the primary object of the present invention to provide a sensing decorative tree which may be used as a decorative tree as well as a burglar-proof device.

It is another object of the present invention to provide a sensing decorative tree which may be used as an advertising device.

It is still another object of the present invention to provide a sensing decorative tree in which the sensor may be adjusted in any desired direction.

It is still another object of the present invention to provide a sensing decorative tree which is simple in construction.

It is a further object of the present invention to provide a sensing decorative tree which is practical in use.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Figure 1:
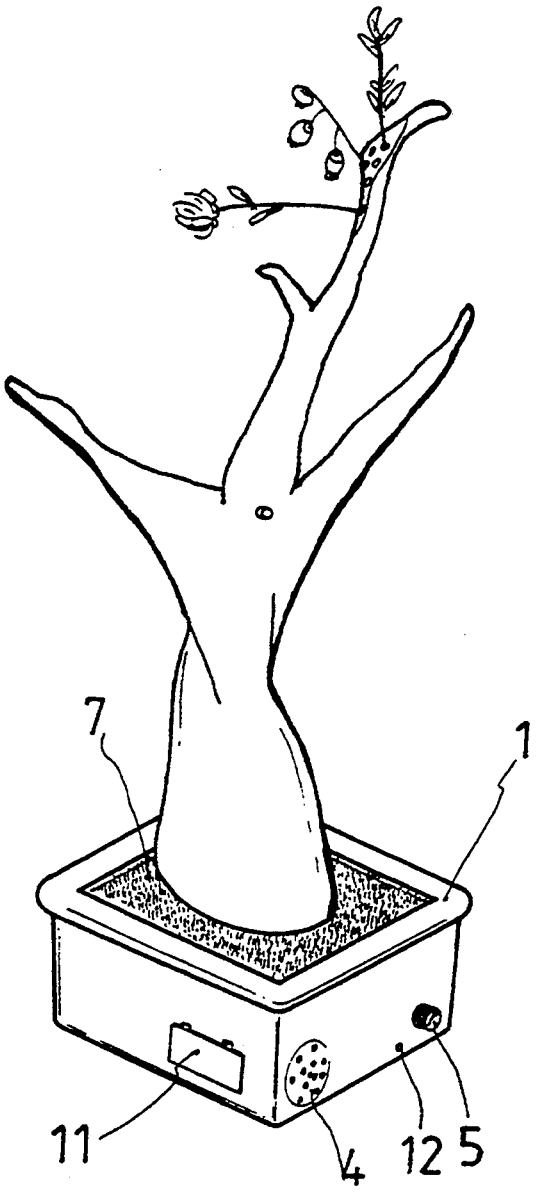
FIG. 1 is a perspective view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2A:
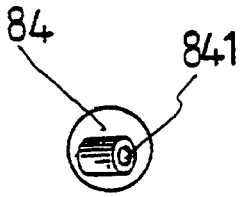
FIG. 2A is a perspective view of the sleeve.
Figure 2:
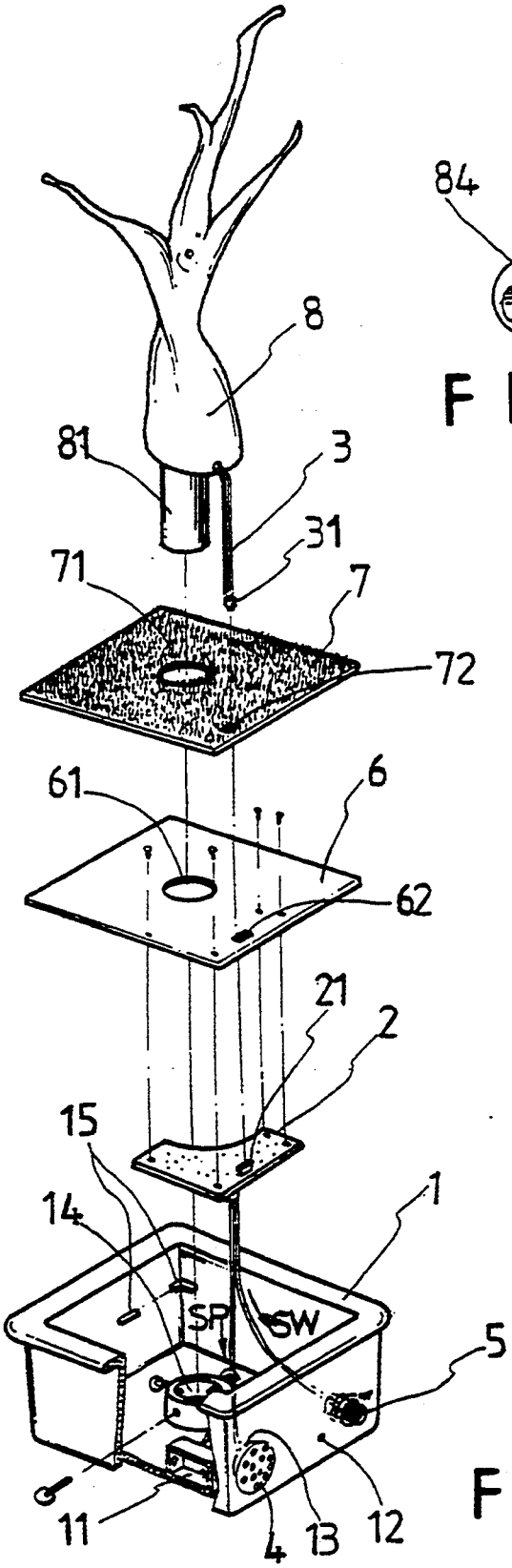
FIG. 2 is an exploded view of the present invention.
Figures 4, 4A, 4B:
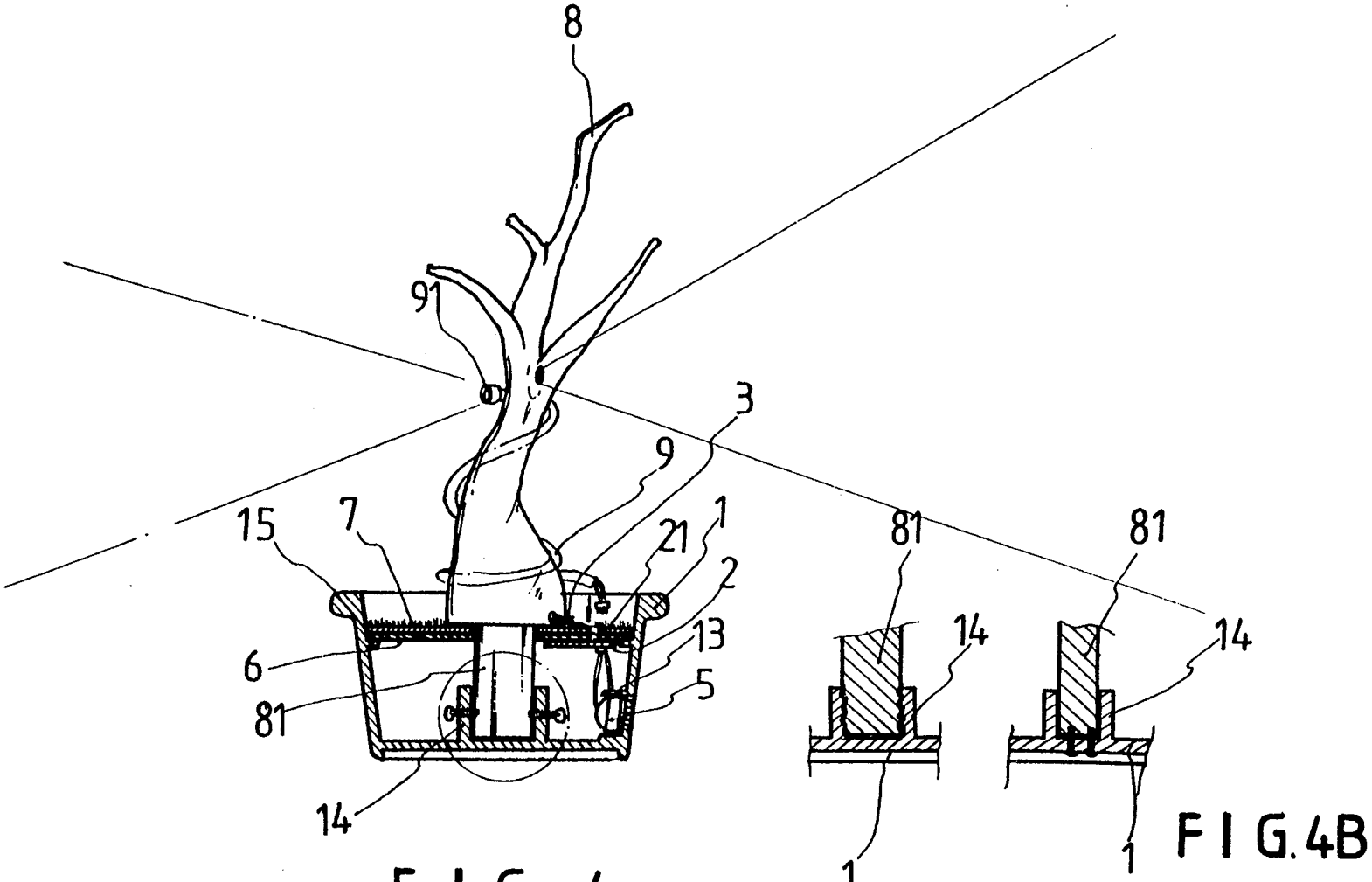
FIG. 4 is a sectional view of the present invention.
FIG. 4A is an enlarged fragmentary sectional view showing the connection between the lower end of the trunk and the pot.
FIG. 4B is an enlarged fragmentary sectional view showing another preferred connection between the lower end of the trunk and the port.

With reference to the drawings and in particular to FIGS. 1 and 2 thereof, the present invention mainly comprises a pot 1, a voice producer 2, a sensing wire 3, an amplifier 4, a volume control 5, a cover 6, an artificial lawn 7, a flexible trunk 8, and a plurality of flexible canes 9 (FIG. 4). Within the pot 1 there is a battery chamber 11. Further, the pot 1 is provided with an outlet 12 for connecting an external AC power supply (not shown). In addition, the pot 1 has a seat 13 for fixing the amplifier 4 in position. The amplifier 4 is electrically connected with the volume control 5. The volume control 5 is mounted at one side of the pot 1 for adjusting the volume of the voice produced by the voice producer 2 which is electrically connected with the amplifier 4. The sensing wire 3 is electrically connected with the voice producer 2.

As shown in FIG. 2, the bottom of the pot 1 is provided with a raised annular member 14 in which is fitted the lower end 81 of the trunk 8. On the inner sides of the pot 1 there are a plurality of protuberances 15 for supporting the partition plate 6 on which is disposed the artificial lawn 7.

Figure 3:
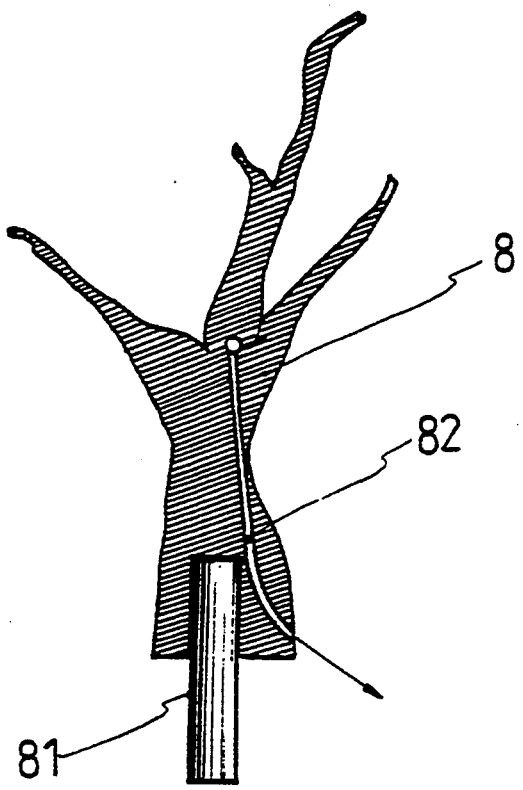
FIG. 3 is a sectional view of the trunk.

The lower end 81 of the trunk 8 may be an independent member so that the trunk 8 and the lower end 81 can be snugly fitted together or glued together. The trunk 8 is formed with a passage 82 (see FIG. 3) for receiving the sensing wire 3. The sensing wire 3 is provided with a sensor (not shown) at the upper end and a plug 31 at the lower end. A sleeve 84 (see FIG. 2A) is inserted in the upper outlet of the passage 82 and has an opening 841 for receiving the sensor of the sensing wire 3 thereby protecting the sensor from being damaged. It should be noted that the sensor may be a ultra-red sensor or one which can detect the body temperature of a human being.

As illustrated in FIGS. 2 and 4, the artificial lawn 7 and the partition plate 6 are respectively formed with holes 71 and 61, and slots 72 and 62. The partition plate 6 is mounted on the protuberances 15 of the pot 1 while the artificial lawn 7 is disposed on the partition plate 6. The voice producer 2 is fixedly mounted on the bottom of the partition plate 6, with its socket 21 extending upwardly through the slot 62 of the partition plate 6 and the slot 72 of the artificial turf 7 for receiving the plug 31 of the sensing wire 3.

Figure 5:
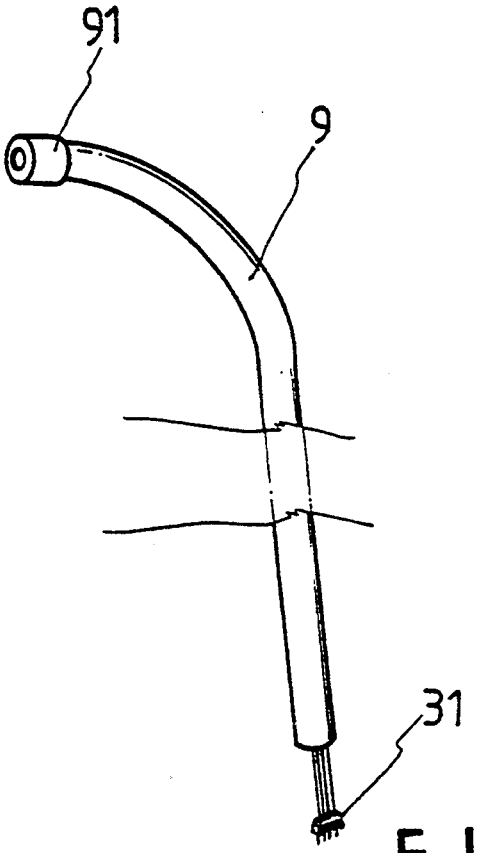
FIG. 5 is a perspective view of the cane.
Figure 6:
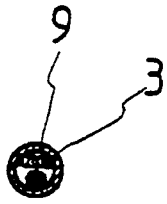
FIG. 6 is a sectional view of the cane.
Figure 7:
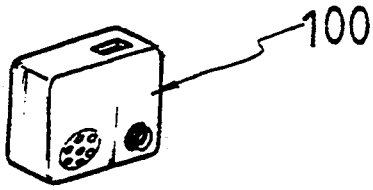
FIG. 7 shows the external voice producer.

Looking now at FIGS. 5 and 6, the cane 9 is a tubular member in which is inserted a sensing wire 3 so that the sensor of the sensing wire is received in the upper end 91 of the cane 9 while the plug 31 of the sensing wire 3 extends downwardly the slot 72 of the artificial lawn 7 and the slot 62 of the partition plate 6 to connect the socket 21 of the voice producer 2. The plug 31 of the sensing wire 3 disposed within the cane 9 may be connected with an external voice producer 100 shown in FIG. 7.

The invention is naturally not limited in any sense to the particular features specified in the forgoing or to the details of the particular embodiment which has been chosen in order to illustrate the invention.

Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A sensing decorative tree comprising:

a pot provided with a raised annular member on the bottom and a plurality of protuberances on the inner side;

a trunk having a lower end engaged with the raised annular member of said pot, said trunk further having a passage;

a partition plate mounted on the protuberances of said pot;

an artificial lawn mounted on said partition plate;

a voice producer mounted on the bottom of said partition plate;

an amplifier mounted on said pot and electrically connected with said voice producer;

a sleeve inserted in the upper outlet of the passage of said trunk;

a sensing wire provided at one end with a plug connected with said voice producer and at the other end with a sensor received in said sleeve;

a volume control mounted in said pot and electrically connected with said amplifier for controlling volume of said amplifier; and a plurality of flexible canes twisted on said trunk and provided at one end with a plug electrically connected with said voice producer and at the other end with a sensor.

2. The sensing decorative tree as claimed in claim 1, wherein the lower end of said trunk is fixedly mounted on the pot by screws.

3. The sensing decorative tree as claimed in claim 1, wherein each of said canes can be connected with an external voice producer.

* * * * *